US006649581B1

(12) United States Patent
Lalle et al.

(10) Patent No.: US 6,649,581 B1
(45) Date of Patent: Nov. 18, 2003

(54) METHOD FOR CLEANING THERMOPLASTIC MATERIAL AND ALKALINE COMPOSITION FOR THE CLEANING THEREOF

(76) Inventors: Jean-Yves Lalle, 35, Boulevard Jobert, F-22400 Lamballe (FR); Marie-Jeanne Lalle, 35, Boulevard Jobert, F-22400 Lamballe (FR)

( * ) Notice: Subject to any disclaimer, the term of this patent is extended or adjusted under 35 U.S.C. 154(b) by 0 days.

(21) Appl. No.: 10/019,938

(22) PCT Filed: Jul. 5, 2000

(86) PCT No.: PCT/FR00/01921

§ 371 (c)(1),
(2), (4) Date: Jan. 7, 2002

(87) PCT Pub. No.: WO01/02107

PCT Pub. Date: Jan. 11, 2001

(30) Foreign Application Priority Data

Jul. 5, 1999 (FR) ..... 99 08888

(51) Int. Cl.[7] ..... C11D 3/22
(52) U.S. Cl. ..... 510/219
(58) Field of Search ..... 510/219, 243, 510/244

(56) References Cited

U.S. PATENT DOCUMENTS

| | | | | |
|---|---|---|---|---|
| 3,908,680 A | | 9/1975 | Krezanoski | |
| 5,389,278 A | * | 2/1995 | Minns et al. | 252/102 |
| 5,389,283 A | | 2/1995 | Held, III | |
| 5,522,580 A | * | 6/1996 | Varner et al. | 252/102 |
| 5,786,315 A | | 7/1998 | Sadlowski | |

FOREIGN PATENT DOCUMENTS

| | | |
|---|---|---|
| CA | 2166695 | 1/1995 |
| DE | 4322328 | 1/1995 |

* cited by examiner

*Primary Examiner*—Yogendra N. Gupta
*Assistant Examiner*—John M Petruncio
(74) *Attorney, Agent, or Firm*—Young & Thompson

(57) ABSTRACT

An alkaline cleaning composition and a method which can be used to clean all types of flexible woven or unwoven, laminated or non-laminated thermoplastic films or thermoplastic material. The method is characterized in that it includes at least one washing step in an alkaline medium in a bath in the presence of an alkaline washing composition including at least 5–8% soda, 3–12% carbonated soda, 10–28% sodium perborate and 0–10% surfactant(s), whereby the step is performed at a sufficiently low temperature in order to avoid any shrinkage or deformation of the above-mentioned film or material.

17 Claims, No Drawings

METHOD FOR CLEANING THERMOPLASTIC MATERIAL AND ALKALINE COMPOSITION FOR THE CLEANING THEREOF

The present invention relates to a cleaning process applicable to any laminated or nonlaminated, woven or nonwoven, thermoplastic material or flexible thermoplastic film and to an alkaline composition for said cleaning.

The present invention relates more particularly to a cleaning process applicable to any thermoplastic material made of impact polystyrene or of [sic] flexible thermoplastic film made of woven polypropylene or laminated or nonlaminated polyethylene and to an alkaline composition for said cleaning. These materials are encountered in the composition of numerous packaging types, for example in the form of big bags for the transportation of mainly food, chemical or cosmetic raw materials (milk powder, coffee, cocoa, condiments, carbon black, zinc oxide, and the like). These bags are known under the names of "flexible container", FIBC (Flexible Intermediate Bulk Container) or "big bag" and are commonly used in industry.

After use, these materials can vary widely in condition, extending, for the most extreme cases, to the sometimes significant presence of mold, and their use in the food field therefore renders them particularly sensitive to the propagation of microorganisms or microbes (aerobic mesophilic flora, *Escherichia coli*, yeasts, molds, and the like). Unfortunately, as their composition shows poor resistance to high temperatures, the application of a conventional treatment, which consists in boiling them to obtain a sterilization compatible with contact with foodstuffs, irreversibly modifies their physical properties (shape, volume, sturdiness, conducting structure) and, when they are in the form of flexible containers, this treatment also damages the components of use to their users which they comprise, such as printing, logos, labels or document holders. It has in fact been observed, with certain containers made of polypropylene or polyethylene which have been subjected to an excessively severe treatment, that significant shrinkage occurs and that stacking is rendered difficult.

U.S. Pat. No. 3,908,680 has disclosed a process intended essentially for cleaning and for bleaching contact lenses which consists in bringing the lens into contact with a first aqueous solution and then with a second aqueous solution, one being acidic and the other basic, each of these solutions comprising a peroxo compound which releases active oxygen, in bringing the lens into contact with an ionic detergent, and in rinsing the lens with water. However, this process relates to the field of contact lenses, which is far removed from the fields of applications of the present invention. Furthermore, the contact lenses are not subjected to mechanical washing using an alkaline composition of detergent type.

Furthermore, European Directive 94/62/EC of December 94, relating to packaging and packaging waste, and French Decree No. 98-638 of July 98, relating to the taking into consideration of environmental requirements in the design and manufacture of packaging, provide measures and encourage solutions targeted at reusing all types of packaging, including those comprising the materials in question in their composition. This is because the latter are, for the most part, commonly discarded after a single use as, despite strong demand, the absence of a cleaning process which is effective without being too aggressive currently prevents any reuse of them.

The aim of the present invention is to provide a cleaning process and a cleaning composition which meet this demand without harming the qualities which characterize these materials when they are used.

A first subject matter of the present invention is a process for cleaning laminated or nonlaminated, woven or nonwoven, thermoplastic material or flexible thermoplastic film, for example in the form of big bags for the transportation of mainly food, chemical or cosmetic products, characterized in that it comprises, at a temperature sufficiently low to prevent any shrinkage and deformation of the abovementioned material or film, at least one stage of washing in an alkaline medium in a bath in the presence of an alkaline washing composition comprising at least from 5 to 18% of sodium hydroxide, from 3 to 12% of sodium carbonate, from 10 to 28% of sodium perborate and from 0 to 10% of surfactant(s), preferably from 2 to 10% of surfactant(s). The remainder of the alkaline composition is composed of a neutral support powder comprising a fragrance and/or various specific substances, such as a wetting agent, and/or of water, when the composition is in the liquid form. A single washing in an alkaline medium may be acceptable depending upon the use which will be made of the material or film, in particular in the field of chemistry.

According to another distinguishing feature, the stage of washing in an alkaline medium is followed by a stage of washing or sterilizing in a bath in the presence of a bleaching and disinfecting agent, and/or a stage of neutralization of the alkaline medium by an acidic product. These stages may prove to be necessary according to the field of application of the thermoplastic material or film, such as, for example, in the food-processing field.

Another subject matter of the present invention is a process for cleaning and sterilizing laminated or nonlaminated, woven or nonwoven, thermoplastic material or flexible thermoplastic film, for example in the form of big bags for the transportation of mainly food, chemical or cosmetic products, characterized in that it comprises at least the following stages at a temperature sufficiently low to prevent any shrinkage and deformation of the abovementioned material or film:

- a stage of washing in an alkaline medium in a bath in the presence of an alkaline washing composition,
- a stage of washing or sterilizing in a bath in the presence of a bleaching and disinfecting agent, and
- a stage of neutralization of the alkaline medium by an acidic product.

According to one distinguishing feature, the two washing stages are carried out at a temperature of between 20 and 70° C.

According to another distinguishing feature, the two washing stages are each carried out over a duration of between 10 and 30 minutes.

The neutralization stage is advantageously carried out at an ambient temperature or under cold conditions.

The process advantageously comprises a pretreatment by wetting with cold water and/or followed by a post-treatment stage consisting of rinsing with water at an ambient temperature or under cold conditions. The entire treatment can be followed by spin-drying and/or by drying.

According to one distinguishing feature, the washing in an alkaline medium is carried out with an alkaline washing composition with a pH of between 10 and 14 and the neutralization of the medium is carried out with an acidic product with a pH of between 2 and 6.

According to another distinguishing feature, the concentration of the alkaline composition is from 15 to 155 grams per kilogram of dry material to be cleaned.

The bleaching and disinfecting agent is advantageously a solution of chlorine, of permanganate or hydrogen peroxide.

The chlorine solution advantageously comprises sodium hypochlorite, chlorine and active chlorine.

According to one distinguishing feature, the concentration of bleaching and disinfecting agent is from 0.25 to 6% of the volume of the bath or from 1.5 to 37 grams per kilogram of dry material to be cleaned.

According to another distinguishing feature, the neutralization product is sodium hydrogensulfite or a sodium hydrogensulfite and sulfur dioxide composition. According to one characteristic, the concentration of neutralization product is from 1 to 25 grams per kilogram of dry material to be cleaned.

Yet another subject matter of the invention is an alkaline composition for the washing of laminated or nonlaminated, woven or nonwoven, thermoplastic material or flexible thermoplastic film, characterized in that it comprises at least from 5 to 18% of sodium hydroxide, from 3 to 12% of sodium carbonate, from 10 to 28% of sodium perborate and from 0 to 10% of surfactant(s), preferably from 2 to 10% of surfactant(s).

The process according to the invention comprises at least one stage of washing in an alkaline medium. Depending upon the use of the material, for example in the food-processing field, this alkaline washing stage will be followed by a stage of washing in the presence of a bleaching and disinfecting agent and/or by a stage of neutralization of the alkaline medium by an acidic product. The two washing stages can be carried out simultaneously by inserting the alkaline composition and the bleaching and disinfecting agent into the same bath. Preferably, the two washing stages are carried out one after the other. The procedure comprises several highly distinct phases, the parameters of which (durations, amounts of products, temperatures) can be adjusted according to the state of cleanliness of the thermoplastic film observed before application of the process in question.

The washing in an alkaline medium is carried out with a product or a composition with a pH of between 10 and 14 and the neutralization of the medium with an acidic product with a pH of between 2 and 6. The washing in an alkaline solution can be carried out at a temperature of between 20 and 70° C., preferably between 37 and 52° C., for a duration of between 10 and 30 minutes, preferably between 15 and 20 minutes. The alkaline product used can be a detergent comprising alkaline products and sodium perborate, and optionally surfactants, it being possible for the alkaline products to be sodium hydroxide and sodium carbonate. The concentration of the alkaline product varies from 15 to 155 grams per kilogram of dry material to be cleaned. The alkaline product, which can be provided in the liquid form or in the powder form, comprises, as the active constituents, from 5 to 18% of sodium hydroxide, from 3 to 12% of sodium carbonate, from 10 to 28% of sodium perborate and from 0 to 10% of surfactant(s), preferably from 2 to 10% of surfactant(s). The remainder of the alkaline product can be composed of a neutral support powder and/or of any other specific substance, such as wetting agents, for example, and/or of water, when the product is in the liquid form. The support powder, which can represent from 30 to 35% of the alkaline product, comprises fine neutral particles of one or more fragrances, such as lavender or lemon grass, for example.

The bleaching and disinfecting product is a chlorine solution, for example comprising sodium hypochlorite, chlorine and active chlorine, or a solution of permanganate or of hydrogen pyroxyl [sic]. The concentration of the solution of bleaching and disinfecting product is 0.25 to 6% of the volume of the bath or from 1.5 to 37 grams per kilogram of dry material to be cleaned.

The neutralization product is, for example, composed of sodium hydrogensulfite or a sodium hydrogensulfite and sulfur dioxide composition. The phase of neutralization of the alkaline medium by an acid, from 1 to 15 minutes, preferably from 1 to 5 minutes, can be carried out under cold conditions. The concentration of the neutralization product varies from 1–25 g/kg of dry material. A pH measurement on conclusion of this phase must confirm the neutrality of the medium (pH=7).

The washing in a bleaching and disinfecting solution can last from 10 to 30 minutes, preferably from 15 to 20 minutes, at a temperature of between 20 and 70° C., preferably between 37 and 52° C.

In order to prolong the lifetime of these materials and not to apply an inappropriately aggressive treatment to them, it is possible to adjust the durations, the amounts of products and the temperatures used in each stage according to the observed condition of the material before treatment. It is possible, for example, to divide or multiply by 2 the amount of bleaching solution with respect to that used for an average presence of mold. The concentration of the bleaching and disinfecting solution, the temperature and the duration of this stage must be such that complete disappearance of the traces of mold or stains will be observed, preferably without detrimentally affecting the writing, logos or labels printed on the flexible containers.

The three abovementioned phases, known as the main phases, can be preceded by a phase of pretreatment by wetting with or presoaking in cold water in order to remove the superficial residues of products with which the treated material has been in contact during use and can be followed by a post-treatment stage consisting of one or more rinsings with cold water to remove any residual trace of product used during the three main phases. A rinsing, a soaking or a neutralization "under cold conditions" or "at ambient temperature" means that the water used for these stages originates from a conventional water mains, either directly or slightly heated, which corresponds to a water temperature of between 10 and 25° C. The wetting stage can be carried out for a duration of 1 to 20 minutes, preferably of 5 to 10 minutes, and the rinsing can be carried out for a duration of 1 to 10 minutes, preferably of 1 to 5 minutes.

In the case of flexible thermoplastic films, such as those used for FIBCs or big bags, the latter can be cleaned by mechanical action in a conventional drum washing machine which makes possible the application of the present process with a few adaptations with regard to the size of the drum and its rotational speed. Depending upon the size of the FIBCs, the latter will be placed in the machine in the style of an accordion, without folds, or in the rolled up form. In order to facilitate the circulation of the water, the bags will preferably be open at their two sides and arranged in the style of an accordion or in the form rolled up in a direction parallel to the path through the open bag. The water inlets in the washing machine are arranged so as to circulate the water through the bags in an optimum manner. The entire treatment can be followed by spin-drying, advantageously under cold conditions, for 1 to 10 minutes, preferably for 1 to 5 minutes, and then by flame drying or steam drying for 45 to 200 minutes at a temperature, sufficiently low to prevent any shrinkage and deformation of the film, of between 25 and 65° C.

The rotational speeds for the cleaning, sterilization, neutralization and drying will be adjusted to the various types of FIBC film and are within the range from 10 to 43 revolutions per minutes [sic]. For the spin-drying, the rotational speed can vary according to the machine used, for example from 400 to 1200 revolutions per minutes [sic].

In the case of the cleaning of thermoplastic material of impact polystyrene type (often in the form of transportation pallets) or hard polypropylene type, for example, the cleaning will require the use of a tunnel.

The application of the process requires the connection to a treatment plant owned by the company or a community treatment plant (the company should be linked to the community treatment plant by a discharge agreement). In both cases, samples will be withdrawn from the discharged materials and analyzed by a laboratory authorized for this purpose. A catch pit will be installed between the production unit and the collecting system, and will transport the wastewater to the plant. This pit will be equipped with multiple monitoring devices (flow rate, temperature, pH, automatic and cooled sampling device).

The process according to the invention is intended in particular for laundries, for manufacturers, for those using the abovementioned materials, for components manufacturers and for any company interested in the exploitation of this market.

The main parameters of the various stages of a cleaning cycle according to the invention are summarized in table I below.

TABLE I

| Phase | Product | T(° C.) | Duration (min) | Amounts |
|---|---|---|---|---|
| Soaking | water | under cold conditions | 1 to 20 (5 to 10)* | — |
| Alkaline washing | detergent | 20 to 70 (37 to 52)* | 10 to 30 (15 to 20)* | 15–155 g/kg mat. |
| Sterilizing washing | bleach. and disinf. product | 20–70 (37 to 52)* | 10 to 30 (15 to 20)* | 1.5–37 g/kg mat. |
| Neutral. | neutr. product | under cold conditions (10–25) | 1 to 10 (1 to 5)* | 1–25 g/kg mat. |
| Rinsing | water | under cold conditions (10–25) | 1 to 10 (1 to 5)* | — |
| Spin-drying | — | under cold conditions (10–25) | 1 to 10 (1 to 5)* | — |
| Drying | — | 25 to 65 | 45 to 200 | — |

(*)preferred range

EXAMPLE OF CLEANING AND STERILIZING CYCLE

Table II exhibits, as nonlimiting example, the various parameters for cleaning about 50 kg of moderately dirty FIBCs in the presence of mold. The products used in the process are presented in table III.

TABLE II

| Phase | Product | T(° C.) | Duration (min) | Amounts |
|---|---|---|---|---|
| Soaking | water | Under cold conditions | 5 | — |
| Washing | detergent | 45 | 20 | 20 g/kg mat. |
| Washing | bleach. and disinf. prod. | 45 | 16 | 1.5 l/200 l water |
| Neutral. | neutr. prod. | under cold conditions | 2 | 3 g/kg mat. |
| Rinsing | water | under cold conditions | 2 | — |
| Spin-drying | — | under cold conditions | 8 | — |
| Drying | — | 60 | 120 | — |

TABLE III

| Product | Main components | pH |
|---|---|---|
| Detergent | Sodium hydroxide<br>Na carbonate<br>Sodium perborate<br>Surfactant | 12 to 13 |
| Bleaching and disinfecting product | Na hypochlorite (NaClO)<br>Chlorine/Active chlorine (47/50°) | 12 to 13<br>at 100% |
| Neutralization product | Sulfur dioxide (24.2% $SO_2$)<br>Na hydrogensulfite ($NaHSO_3$) | 3.5 to 5 |

(Na = Sodium)

As indicated in tables II and III, the durations of the various phases can be 5, 20, 16, 2, 2, 8 and 120 minutes respectively, at ambient temperature for the wetting, neutralization and spin-drying phases, and at 45° C. for the 2 phases of washing in an alkaline solution and in a bleaching solution, and at 60° C. for the final drying. The amount of water can be 300 liters per phase. The products used can be:

- detergent, in a proportion of 20 g/kg of material to be cleaned, for the phase of washing in an alkaline medium,
- a chlorine solution (47°/50°Cl) as bleaching and disinfecting solution, in a proportion of approximately 1.5 grams/liter, i.e. approximately 1.5 liters/200 liters of water in the bath.
- sodium hydrogensulfite (sodium bisulfite) with sulfur dioxide (24.2% of $SO_2$) for neutralizing the basic medium, in a proportion of 3 g per kg of material to be cleaned.

In this example, the chlorine solution can be replaced by permanganate or hydrogen pyroxyl [sic], for example.

The detergent comprising the active components described in table III is in the powder form and additionally comprises a support powder. The detergent comprises from 5 to 18% of sodium hydroxide, from 3 to 12% of sodium carbonate and 10 to 20% of sodium perborate. The surfactant(s), which modify(ies) the surface tension of the liquid in which the detergent is dissolved, can represent from 2 to 10% of the composition, the support powder representing the remainder.

COMPARATIVE EXAMPLES OF CLEANING AND STERILIZING CYCLES

In the examples which follow, bags of FIBC type, dirty to varying degrees, were treated according to the process according to the invention. The tests were carried out on a first new bag (bag A), a second moderately dirty bag (bag B) and a third very dirty bag (bag C) exhibiting a very large amount of mold. Each bag, prior to the treatments, was subjected to a microbiological analysis relating to various microorganisms or microbes. The microorganisms which were tested for, the results obtained for the analyses of samples withdrawn by contact plates on the new bag A, the moderately dirty bag B and the very dirty bag C, and the concentrations desired for each microorganism after a treatment according to the invention are shown in table IV below.

TABLE IV

| | Bag A | Bag B | Bag C | Desired res. |
|---|---|---|---|---|
| Aerobic mesophilic flora | 55 | >300 | * | <20 |
| Yeasts (YGC) | 9 | >150 | * | 0 |
| Molds (YGC) | 0 | >200 | * | 0 |
| Salmonella | 0 | 37 | * | 0 |
| *Escherichia coli* | 0 | >60 | * | 0 |

*: innumerable

As the contact plates comprising the samples withdrawn from bag C are completely contaminated, the amounts of microorganisms or microbes could not be counted.

The cleaning and sterilizing cycle comprised the following stages:

1. Soaking or wetting
2. Washing in an alkaline medium
3. Washing with bleaching and disinfecting agent
4. Neutralization
5. Rinsing(s)
6. Spin-drying
7. Drying The parameters of the cleaning cycles for each bag are presented in the following tables V–VII. The cleaning cycle was carried out on a standard machine with a capacity of 180 kg of load of dry washing. The products used in the various cycles are those shown in table

TABLE V

Treatment of the new bag A

| Operations | Temp. (° C.) | Duration (min) | Amount of water (liter) | Composition added | pH | Conc. in g/liter of bath | Conc. in g/kg of material | Rotational speed (rev/min) |
|---|---|---|---|---|---|---|---|---|
| Soaking | 25 | 3 | 280 | — | 7 | — | — | 33 |
| Alkaline washing | 55 | 15 | 280 | Detergent | 12 | 10 | 63 | 33 |
| Bleach. and disinfect. washing | 47 | 15 | 280 | NaClO 47/50° Cl | 8 | 5.5 | 35 | 33 |
| Neutralization | 20 | 3 | 280 | $NaHSO_3$ | 4 | 0.5 | 3 | 33 |
| Rinsings | 20 | 3 | 320 | | 7 | — | — | 33 |
| Spin-drying | — | 8 | — | | — | — | — | 750 |
| Drying | 60 | 120 | — | | — | — | — | 38 |

TABLE VI

Treatment of the moderately dirty bag B

| Operations | Temp. (° C.) | Duration (min) | Amount of water (liter) | Composition added | pH | Conc. in g/liter of bath | Conc. in g/kg of material | Rotational speed (rev/min) |
|---|---|---|---|---|---|---|---|---|
| Soaking | 25 | 5 | 280 | — | 7 | — | — | 33 |
| Alkaline washing | 55 | 17 | 280 | Detergent | 12 | 20 | 125 | 33 |
| Bleach. and disinfect. washing | 47 | 15 | 280 | NaClO 47/50° Cl | 8 | 5.5 | 35 | 33 |
| Neutralization | 20 | 3 | 280 | $NaHSO_3$ | 4 | 0.5 | 3 | 33 |
| Rinsings | 20 | 3 | 320 | | 7 | — | — | 33 |
| Spin-drying | — | 8 | — | | — | — | — | 750 |
| Drying | 60 | 120 | — | | — | — | — | 38 |

TABLE VII

Treatment of the very dirty bag C

| Operations | Temp. (° C.) | Duration (min) | Amount of water (liter) | Composition added | pH | Conc. in g/liter of bath | Conc. in g/kg of material | Rotational speed (rev/min) |
|---|---|---|---|---|---|---|---|---|
| Soaking | 25 | 8 | 280 | — | 7 | — | — | 33 |
| Alkaline washing | 55 | 20 | 280 | Detergent | 12 | 25 | 155 | 33 |
| Bleach. and disinfect. washing | 47 | 15 | 280 | NaClO 47/50° Cl | 8 | 5.5 | 35 | 33 |
| Neutralization | 20 | 3 | 280 | $NaHSO_3$ | 4 | 0.5 | 3 | 33 |
| Rinsings | 20 | 3 | 320 | | 7 | — | — | 33 |
| Spin-drying | — | 8 | — | | — | — | — | 750 |
| Drying | 60 | 120 | — | | — | — | — | 38 |

TEST OF RESISTANCE TO AND OF LOAD AT FAILURE

Test trials of resistance to and of load at failure, according to French standard AFNOR H34 012 (European standard CEN 1898), were carried out on bags of big bag type in the following way. The bags, comprising four gripping members, are filled with a filling product and are suspended by said members by means of a suspending frame, a flat back-pressure plate being positioned at the surface of the filling product. According to the method of carrying out the trial, the suspending frame is stationary and a vertical tensile load is gradually applied downward by the back-pressure plate, or the plate is kept stationary via the top or bottom and a gradual tensile load is applied by the suspending frame. The bag is subjected to a repeated cycle of loading, unloading and pausing. The tensile strength is recorded and the behavior of the bag is monitored visually in order to observe any gripping member failure, any other damage or any loss of filling product.

The bags tested were approved for a maximum working load (MWL). Thus, the bags tested were subjected to 70 cycles under a load of 4×1,250 kg (5,000 kg) and, at the 71st cycle, the minimum failure load must be 6×1,250 kg (7,500 kg) [sic].

Bags which have been subjected beforehand to 25 or 60 cleaning operations according to the invention were tested and all exhibited a load at failure substantially identical to that of new bags, of the order of 9,600 kg.

Furthermore, tests have shown that the bags of FIBC type retain, after treatment, all their initial qualities of electrostatic conductivity.

The tests and analyses carried out on the bags after application of the present process have confirmed that the present process makes possible efficient cleaning without adversely affecting the qualities which characterize these materials during their use.

What is claimed is:

1. A process for cleaning laminated or nonlaminated, woven or nonwoven, thermoplastic material or flexible thermoplastic film, in the form of bags for the transportation of food, chemical or cosmetic products, which comprises, at a temperature sufficiently low to prevent any shrinkage and deformation of said thermoplastic material or film, at least one stage of washing in an alkaline medium in a bath in the presence of an alkaline washing composition comprising at least from 5 to 18% of sodium hydroxide, from 3 to 12% of sodium carbonate, from 10 to 28% of sodium perborate and from 0 to 10% of surfactant.

2. The cleaning process as claimed in claim 1, wherein the stage of washing in an alkaline medium is followed by a stage of washing or sterilizing in a bath in the presence of a bleaching and disinfecting agent, and/or a stage of neutralization of the alkaline medium by an acidic product.

3. A process for cleaning and sterilizing laminated or nonlaminated, woven or nonwoven, thermoplastic material or flexible thermoplastic film, in the form of bags for the transportation of food, chemical or cosmetic products, which comprises at least the following stages at a temperature sufficiently low to prevent any shrinkage and deformation of said thermoplastic material or film:

a stage of washing in an alkaline medium in a bath in the presence of an alkaline washing composition comprising at least from 5 to 18% of sodium hydroxide, from 3 to 12% of sodium carbonate, from 10 to 28% of sodium perborate and from 0 to 10% of surfactant, a stage of washing or sterilizing in a bath in the presence of a bleaching and disinfecting agent, and a stage of neutralization of the alkaline medium by an acidic product.

4. The process as claimed in claim 2, wherein the two washing stages are carried out at a temperature of between 20 and 70° C.

5. The process as claimed in claim 2, wherein the two washing stages are each carried out over a duration of between 10 and 30 minutes.

6. The process as claimed in claim 2, wherein the neutralization stage is carried out at an ambient temperature or under cold conditions.

7. The cleaning process as claimed in claim 1, wherein it is preceded by a pretreatment by wetting with cold water and/or followed by a post-treatment stage consisting of rinsing with water at an ambient temperature or under cold conditions.

8. The cleaning process as claimed in claim 1, wherein the entire treatment is followed by spin-drying and/or by drying.

9. The cleaning process as claimed in claim 1, wherein the washing in an alkaline medium is carried out with an alkaline washing composition with a pH of between 10 and 14.

10. The cleaning process as claimed in claim 2, wherein the neutralization of the medium is carried out with an acidic product with a pH of between 2 and 6.

11. The cleaning process as claimed in claim 1, wherein the concentration of the alkaline composition is from 15 to 155 grams per kilogram of dry material to be cleaned.

12. The cleaning process as claimed in claim 2, wherein the bleaching and disinfecting agent is a solution of chlorine, of permanganate or hydrogen peroxide.

13. The cleaning process as claimed in claim 12, wherein the chlorine solution comprises sodium hypochlorite, chlorine and active chlorine.

14. The cleaning process as claimed in claim 2, wherein the concentration of bleaching and disinfecting agent is from 0.25 to 6% of the volume of the bath or from 1.5 to 37 grams per kilogram of dry material to be cleaned.

15. The cleaning process as claimed in claim 2, wherein the neutralization product is sodium hydrogensulfite or a sodium hydrogensulfite and sulfur dioxide composition.

16. The cleaning process as claimed in claim 1, wherein the concentration of neutralization product is from 1 to 25 grams per kilogram of dry material to be cleaned.

17. An alkaline composition for the washing of laminated or nonlaminated, woven or nonwoven, thermoplastic material or flexible thermoplastic film, which comprises at least from 5 to 18% of sodium hydroxide, from 3 to 12% of sodium carbonate, from 10 to 28% of sodium perborate and from 0 to 10% of surfactant.

* * * * *